United States Patent [19]

Scheuermann et al.

[11] 4,281,742

[45] Aug. 4, 1981

[54] SILENCER FOR EXHAUST GASES

[75] Inventors: Albert Scheuermann, Bad Mergentheim; Henning Adickes, Heidelberg, both of Fed. Rep. of Germany

[73] Assignee: Deere & Company, Moline, Ill.

[21] Appl. No.: 128,823

[22] Filed: Mar. 10, 1980

[30] Foreign Application Priority Data

Jul. 28, 1979 [DE] Fed. Rep. of Germany ..... 2930775

[51] Int. Cl.[3] ..... F01N 1/10

[52] U.S. Cl. ..... 181/257; 181/272; 181/275

[58] Field of Search ..... 181/256, 257, 258, 268, 181/269, 272, 275

[56] References Cited

U.S. PATENT DOCUMENTS

| | | | |
|---|---|---|---|
| 3,243,010 | 3/1966 | Flynn | 181/256 |
| 4,126,205 | 11/1978 | Baverschmidt | 181/256 |
| 4,136,757 | 1/1979 | Baverschmidt | 181/256 |

FOREIGN PATENT DOCUMENTS

| | | | |
|---|---|---|---|
| 1092639 | 11/1967 | United Kingdom | 181/258 |

*Primary Examiner*—L. T. Hix

*Assistant Examiner*—Thomas H. Tarcza

[57] ABSTRACT

This invention relates to a silencer for muffling the flow of exhaust gases from an engine before they enter the atmosphere. This silencer comprises a tubular housing having an absorption section with an inlet and an outlet opening. The absorption section is constructed of three walls: and outside wall, a middle wall and a perforated inside wall. Positioned between the middle and outside wall is a layer of heat insulating material and positioned between the middle and inside wall is a layer of sound absorption material. Two symmetrical members are aligned parallel to each other within the absorption section with each member having an inner and an outer wall and a layer of sound absorption material therebetween. When the two symmetrical members are connected together, they form a hollow tubular inlet connector and a hollow tubular outlet connector which have parallel aligned axis. In addition, two longitudinally extending slots are constructed in each tubular connector. These slots communicate with each other by two separate passageways formed by the perforated inside wall of the absorption section and the outer walls of the two symmetrical members. These two passageways channel the exhaust gas through the silencer and out to the atmosphere.

10 Claims, 5 Drawing Figures

SILENCER FOR EXHAUST GASES

BACKGROUND OF THE INVENTION

1. Field of the Invention

This invention relates to a silencer for handling exhaust gases from an engine and particularly to a reduced volume silencer for handling exhaust gases for a diesel engine.

2. Description of the Prior Art

A silencer is a device which is connected to the outlet of an engine for the purpose of muffling the sound and reducing the pressure drop of the exiting exhaust gas. With the advent of smaller and more compact vehicles, the need has arisen to design a silencer which has a smaller external volume but which contains a large absorption area.

A prior art patent that has tried to solve this problem is U.S. Pat. No. 4,126,205 granted to W. Bauerschmidts in November 1978. This patent describes and claims an exhaust gas muffler construction in which two spiral flow passages are contained within a tubular housing in order to fit into a smaller space and have less height. However, this spiral configuration of the flow passages makes for a complicated structure which is difficult to manufacture and costly to produce. Applicants have sought to invent a silencer which is both small and compact and which uses a simple internal directional and absorption means.

SUMMARY OF THE INVENTION

The general object of this invention is to provide a small silencer for handling exhaust gases from an engine. A more specific object of this invention is to provide a compact silencer for handling the exhaust gas of a diesel engine while maintaining good sound and heat insulating properties.

Another object of this invention is to provide a low cost silencer having easy-to-assembly components.

A further object of this invention is to provide a silencer with a small external area but with a large absorption area and an optimum guidance system for the flow of exhaust gases so as to improve the gas pressure drop.

Other objects and advantages will become apparent to one skilled in the art based upon the ensuing description.

Briefly, this invention provides for a silencer for quieting and cooling the exhaust gases from an engine before they enter the atmosphere. The silencer is connected to an exhaust outlet of the engine and is generally positioned beneath the engine hood. The silencer comprises a tubular housing with an inlet and an outlet opening, the inlet opening being connected to the exhaust outlet of the engine while the outlet opening opens to the atmosphere. Within the housing is an absorption section which is formed of three walls: an outside wall, a middle wall and a perforated inner wall. Contained between the outside wall and the middle wall is a layer of heat insulating material and contained between the inside wall and the middle wall is a layer of sound absorption material. Within the absorption section of the housing is a hollow tubular inlet connector and a hollow tubular outlet connector. The hollow tubular inlet connector is attached to the inlet opening and has an axis aligned parallel to the axis of the tubular housing. The hollow tubular outlet connector, which is attached to the outlet opening, also has an axis aligned parallel to that of the tubular housing. The inlet and outlet connectors are formed by fastening together two symmetrical members which have a double arcuate shape. Each member is constructed of two double-wall portions which contain a layer of sound absorption material therebetween. One portion of the member has a circularly shaped, perforated inner wall and a solid outer wall. The second portion of the member differs in that it has a solid inner wall and a perforated outer wall. These two portions are joined together by a traverse web and are positioned within the absorption section of the tubular housing. Each of the inlet and outlet connectors also contain a longitudinally extending slot in its periphery.

When in position, the outer walls of the inlet and outlet connectors form two passageways with the inside wall of the absorption section. These two passageways connect the longitudinally extending slots of the inlet and outlet connectors. As the exhaust gas leaves the engine, it is directed into and through the inlet connector. Within the inlet connector, the exhaust gas is absorbed through the inner perforated wall into the layer of sound absorption material which quiets the flow. As this exhaust gas flows back out of the absorption material, it is channeled through the longitudinally extending slot and through the passageway. While flowing through the passageway to the longitudinally extending slot of the outlet connector, the exhaust gas enters the inside perforated wall of the absorption section. This exhaust gas again penetrates into the sound absorption material, thereby damping its sound. The heat insulating layer surrounding the layer of sound absorption material serves to reduce the amount of exhaust gas heat which radiates from the silencer. The exhaust gas will then pass through the perforated outer wall of the outlet connector and be further damped. Eventually, all of the exhaust gas will flow into the hollow tubular outlet connector and out of the outlet opening to the atmosphere.

Such a silencer combines easy-to-assemble compact parts to form a low cost unit having a large absorption area and an optimum guidance system for the outward flow of the exhaust gases from an engine.

Detailed Description of the Invention

Figure 1:
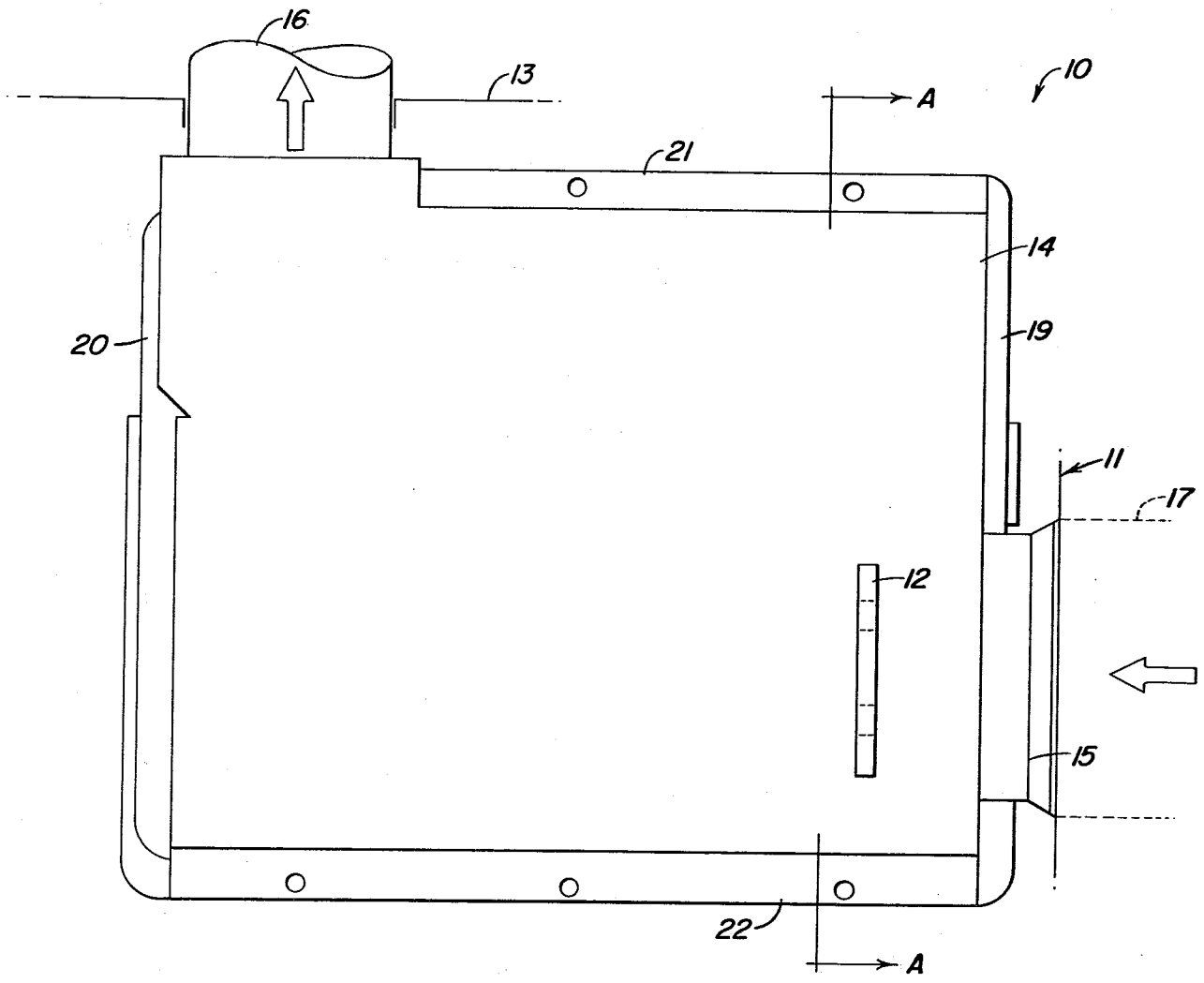
FIG. 1 is a side view of one embodiment of a silencer.

Referring to FIG. 1, a silencer 10 is shown which is designed to be attached to an engine 11 for quieting and cooling the flow of exhaust gases from the engine 11 to the atmosphere. The silencer 10 is mounted to the engine 11 by one or more brackets 12 so that the silencer 10 is positioned beneath an engine hood 13. The engine 11 can be of any design but normally it will be an internal combustion engine of the gasoline or diesel type.

Figure 3:
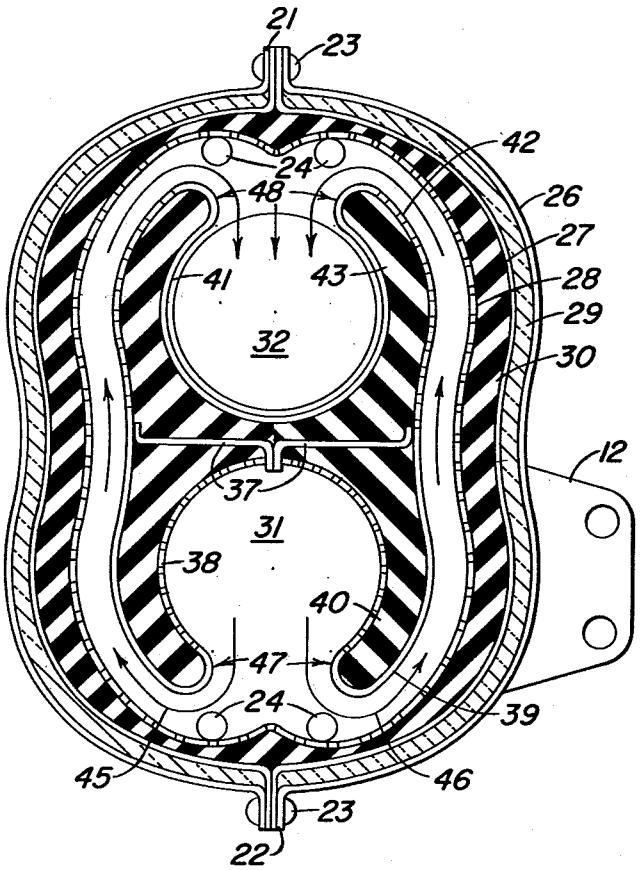
FIG. 3 is a sectional view of FIG. 1 as viewed along line A—A.

The silencer 10 comprises a housing 14, preferably tubular in shape, which has an inlet opening 15 and an outlet opening 16. The inlet opening 15 communicates with an exhaust gas passage 17 located in the engine 11 while the outlet opening 16 opens to the atmosphere. Mounted to the right and left ends of the housing 14 are end plates 19 and 20, respectively, which close off and seal the housing 14. To facilitate assembly, the housing 14 can be formed from two half sections joined together at webs 21 and 22. Rivets 23, as shown in FIG. 3, or other types of fastening devices can be used. Additional rivets or pins 24 can be used to secure the end plates 19 and 20 to the housing 14 (again see FIG. 3).

Figure 2:
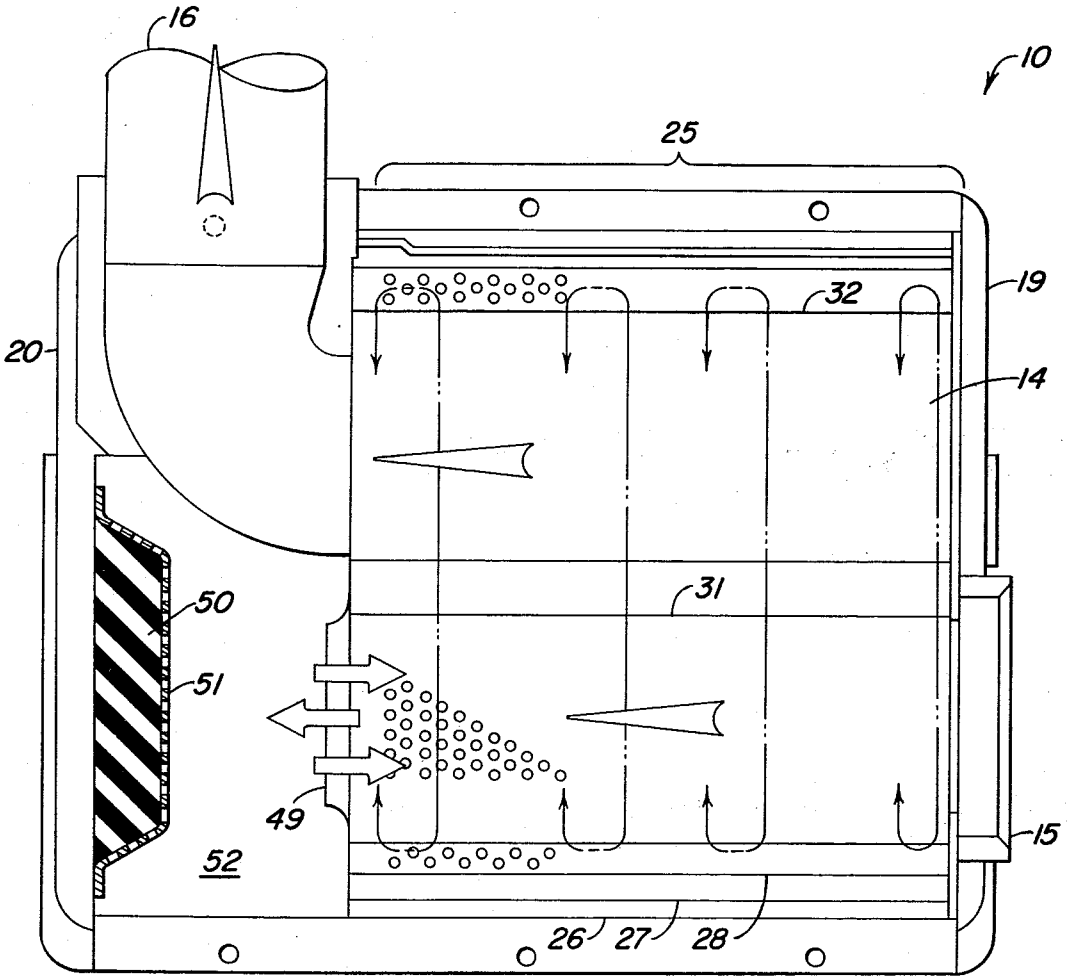
FIG. 2 is a vertical sectional view of FIG. 1.

Now referring to FIGS. 2 and 3, an absorption section 25 is shown contained within the housing 14. This absorption section 25 is connected to the inlet and outlet openings 15 and 16, respectively, and is made up of three walls: an outside wall 26, a middle wall 27, and a perforated inside wall 28. Contained between the outside wall 26 and the middle wall 27 is a layer of heat insulating material 29 which serves to reduce the amount of exhaust gas heat which can radiate from the silencer 10. In addition to the heat insulating material 29, a layer of sound absorption materal 30 is positioned between the middle wall 27 and the perforated inside wall 28. This sound absorption material 30 serves to quiet the exhaust gas before it enters the atmosphere.

Now within the absorption section 25 is an inlet connector 31 and an outlet connector 32. The inlet and outlet connectors 31 and 32, respectively, are hollow tubular members connected to the inlet and outlet openings 15 and 16, respectively. Both connectors 31 and 32 have a longitudinal axis which lies parallel to the axis of the housing 14. These two connectors 31 and 32 serve to direct the flow of the exhaust gas from the engine 11 out to the atmosphere.

Figure 4:
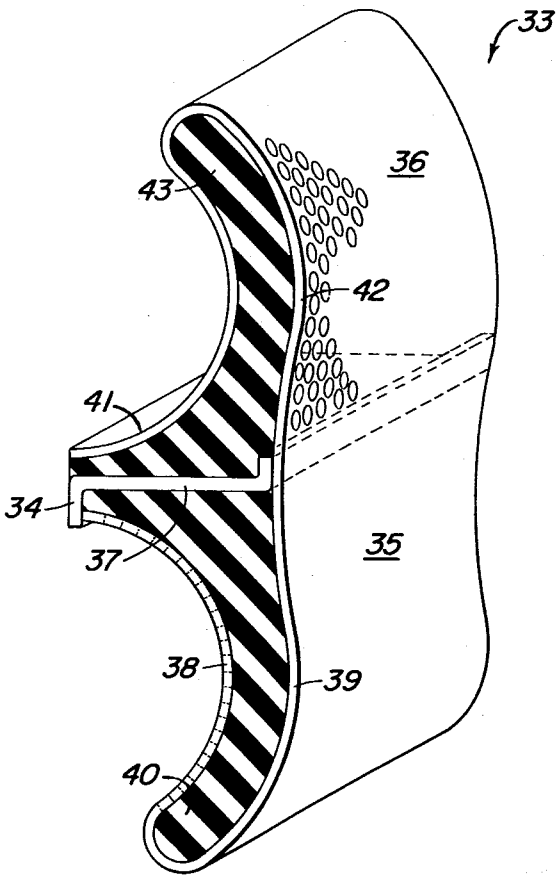
FIG. 4 is an enlarged perspective view of the right half of the internal member in FIG. 2.

As shown in FIG. 4, the inlet and outlet connectors 31 and 32, respectively, are formed by joining together two double arcuately shaped sections 33 at their midpoint 34. Each double arcuately shaped section 33 is constructed of two semi-circular members 35 and 36 connected together by a traverse web 37, preferably made of metal. The circular member 35 which combines with a second similar member to form the inlet connector 31 has a concave perforated inner wall 38 and a convex solid outer wall 39. Positioned between these inner and outer walls 38 and 39, respectively, is a layer of sound absorption material 40. The sound absorption material 40 can be of the same composition as that of sound absorption material 30 contained in the absorption section 25.

Like circular member 35, circular member 36 combines with a second similar member to form the outlet connector 32 and has a concave solid inner wall 41 and a convex perforated outer wall 42. Just like circular member 35, a layer of sound absorption material 43 is positioned between the inner and outer walls 41 and 42, respectively. When circular members 35 and 36 are fastened together, the traverse web 37 completely divides the section 33 and thereby prevents exhaust gas which may enter the sound absorption material 40 from permeating through to the sound absorption material 43, or vice versa.

Referring back to FIG. 3, two of the double arcuately shaped sections 33 are fastened together, for example, by adhesives, and are then inserted into the absorption section 25. Within the absorption section 25, the two double arcuately shaped sections 33 are held in a suspended position away from the perforated inside wall 28 by the end plates 19 and 20, respectively. In this position, two separate passageways 45 and 46 are formed by the outer walls 39 and 42 and the perforated inside wall 28 of the absorption section 25. In addition, the shape of the circular members 35 and 36 is such that two longitudinally extending slots 47 and 48 are constructed when the two double arcuately shaped sections 33 are fastened together. These two longitudinally extending slots 47 and 48 are aligned parallel to each other and preferably as far apart as possible. In operation, the exhaust gas will enter the inlet connector 31 through the inlet opening 15. The exhaust gas will flow through the hollow tubular inlet connector 31 and will penetrate the perforated inner wall 38 wherein the layer of sound absorption material 40 will muffle the sound of the exhaust gas. The exhaust gas will eventually flow past the longitudinally extending slot 47 and be guided by either of the two passageways 45 or 46 to the longitudinal extending slot 48 in the outlet connector 32. As the exhaust gas flows from the inlet connector 31 to the outlet connector 32, it will penentrate through the perforated inside wall 28 of the absorption section and the perforated outer wall 42 of the outlet connector 32. In so doing, the exhaust gas is further muffled by the sound absorption material and is partially cooled by the circulation process. It should be evident that the exhaust gas may enter and exit several different perforated holes during its travel to the outlet connector 32. The double arcuate design of the walls 28, 39 and 42 which define the two flow passages 45 and 46, aid in providing an optimum flow passage for the exhaust gases. In addition, the double arcuate shape is beneficial in improving the pressure drop of the exhaust gas as it flows outward. This improvement in pressure drop is realized because the exhaust gas can expand over the entire length of the inlet and outlet connectors 31 and 32, respectively.

Referring again to FIG. 2, an additional layer of sound absorption material 50 can be employed at the left-hand end 49 of the hollow tubular inlet connector 31. This layer of sound absorption material 50 can be held against the end wall 20 by a perforated plate 51. Furthermore, it is preferable to have an open area 52 between the left-hand end 49 and the perforated plate 51 so that the exhaust gas has room to expand before and after it penetrates into the absorption material 50.

Figure 5:
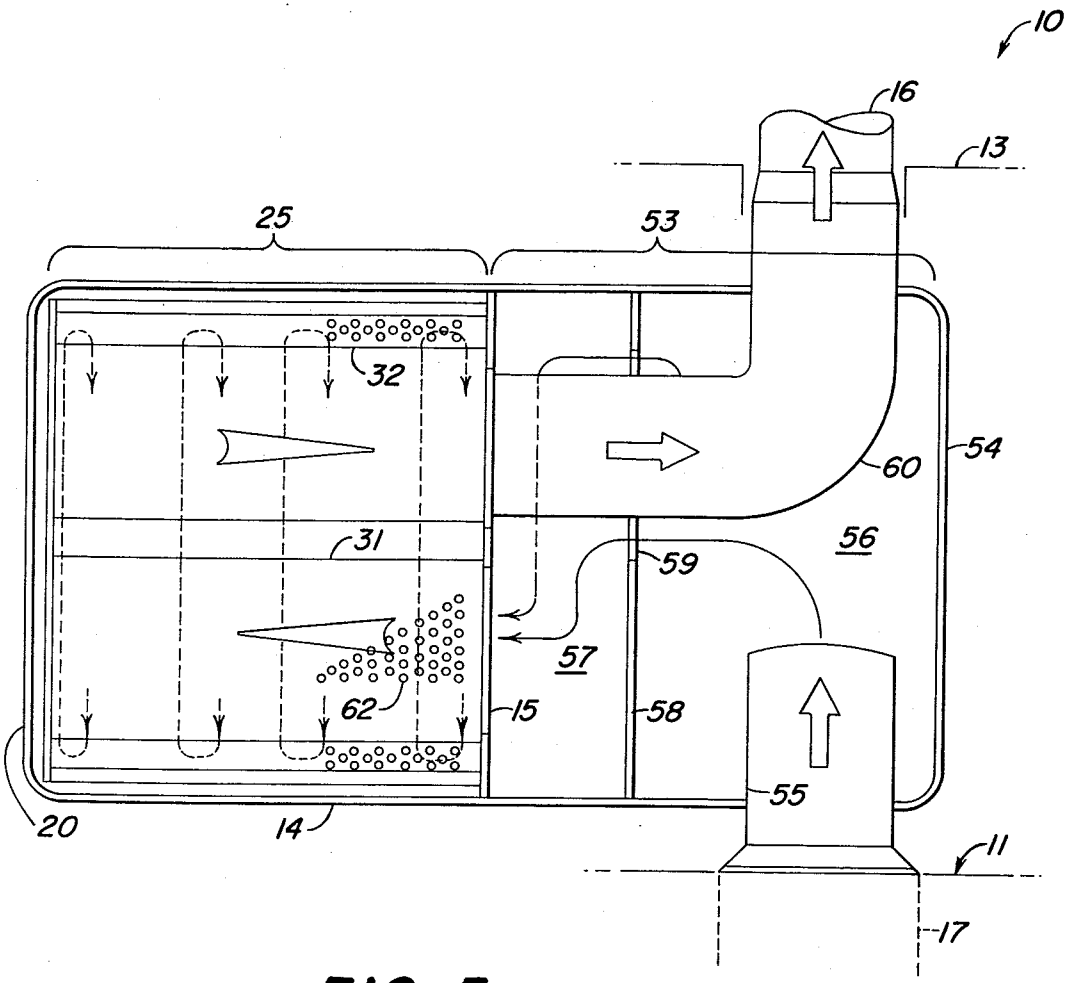
FIG. 5 is a sectional view of a second embodiment of a silencer depicting a reflection portion attached to the absorption section.

Now referring to FIG. 5, a silencer 10 is depicted having both an absorption section 25 and a reflection section 53. The reflection section 53 can either be an extension of the housing 14 with an end cover 54 or it can be a single cup-shaped member. The reflection section 53 contains a large open area in which the exhaust gas can expand, thereby aiding in creating a pressure drop of the gas. Normally, the reflection section 53 is attached to the exhaust gas passage 17 in the engine 11. As the exhaust gas flows through the inlet pipe 55, it enters a first expansion chamber 56 which is positioned upstream of a second expansion chamber 57. The first and second expansion chambers 56 and 57, respectively, are formed by a partition wall 58 having one or more apertures 59 therein. The two expansion chambers 56 and 57 provide two buffer areas which operate independently to muffle the sound and to drop the pressure of the exhaust gas. It should be evident to one of ordinary skill in the art that a plurality of expansion chambers can be used if desired.

From the second expansion chamber 57, the exhaust gas is directed through the inlet opening 15 and then through the absorption section 25. From the absorption section 25, an exhaust pipe 60 is employed to route the quieter and cooler exhaust gas to the atmosphere.

While the invention has been described in conjunction with two specific embodiments, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims.

We claim:

1. A silencer for handling the flow of exhaust gases from an engine which comprises:

(a) a tubular housing having an absorption section with an inlet and an outlet opening communicating therewith, said absorption section comprising an outside wall, a middle wall and a perforated inside wall with a layer of heat insulating material positioned between said outside wall and said middle wall and a layer of sound absorption material positioned between said perforated inside wall and said middle wall;

(b) two symmetrical members aligned parallel to each other within said absorption section, each of said members having an inner wall and an outer wall with a layer of sound absorption material positioned therebetween;

(c) attachment means for joining said two symmetrical members together approximately at their midpoints thereby forming a hollow tubular inlet connector and a hollow tubular outlet connector, said hollow tubular inlet connector having an axis aligned parallel to both the axis of said hollow tubular outlet connector and to the axis of said absorption section, said inlet connector communicating with said inlet opening and having a longitudinally extending slot provided therein, said outlet connector communicating with said outlet opening and having a longitudinally extending slot provided therein aligned opposite said longitudinal slot in said inlet connector; and (d) two separate flow passages formed by the inside wall of said absorption section and the outer walls of said inlet and outlet connectors, said flow passages connecting said longitudinally extending slot of said inlet connector to said longitudinally extending slot of said outlet connector for directing the flow of said exhaust gases therebetween.

2. The silencer of claim 1 wherein said tubular housing comprises a reflection section releasably connected to said absorption section.

3. The silencer of claim 2 wherein said reflection section contains a partitioning wall which divides said reflection section into two chambers.

4. The silencer of claim 1 wherein each of said two symmetrical members comprises two semi-circularly shaped portions affixed together at one end.

5. The silencer of claim 1 wherein said hollow tubular inlet connector contains a perforated inner wall for the flow of exhaust gases therethrough.

6. The silencer of claim 1 wherein said hollow tubular outlet connector contains a perforated outer wall for the flow of exhaust gases therethrough.

7. A silencer for handling the flow of exhaust gases from an engine which comprises:

(a) a tubular housing comprising a reflection section and an absorption section, said reflection section connected to said absorption section and having an inlet opening connected to an exhaust passage of said engine and an outlet opening communicating with the atmosphere, said absorption section having an outside wall, a middle wall, and a perforated inside wall with a layer of heat insulating material positioned between said outside wall and said middle wall, and a layer of sound absorption material positioned between said perforated inside wall and said middle wall;

(b) two symmetrical members aligned parallel to each other within said absorption section, each of said members comprised of an inner wall and an outer wall with a layer of sound absorption material positioned therebetween;

(c) web attachment means for joining said two symmetrical members together at their midpoints thereby forming a hollow tubular inlet connector and a hollow tubular outlet connector, said hollow tubular inlet connector having an axis aligned parallel to both the axis of said hollow tubular outlet connector and to the axis of said tubular housing, said hollow tubular inlet connector communicating with said inlet opening in said reflection section and having a longitudinally extending slot provided therein arranged within said absorption section, said hollow tubular outlet connector communicating with said outlet opening in said reflection section and having a longitudinally extending slot provided therein arranged within said absorption section and aligned opposite to said longitudinally extending slot in said inlet connector; and (d) two separate flow passages located within said absorption section connecting said longitudinally extending slot in said hollow tubular inlet connector to said longitudinally extending slot in said hollow tubular outlet connector for the passage of said exhaust gases therebetween, said flow passages being formed by said perforated inside wall of said absorption section and by said outer walls of said two symmetrical members.

8. The silencer of claim 7 wherein each of said two symmetrical members comprises two semi-circularly shaped portions affixed together.

9. The silencer of claim 7 wherein said inside wall of said absorption section, said inner wall of said inlet connector and said outer walls of said outlet connector are all perforated for the flow of exhaust gases therethrough.

10. A silencer for handling the flow of exhaust gases from an engine which comprises:

(a) a tubular housing comprising a reflection section, an absorption section and a separate expansion area, said reflection section connected to said absorption section and having an inlet opening connected to an exhaust passage of said engine and an outlet opening communicating with the atmosphere, said absorption section having an outside wall, a middle wall and a perforated inside wall with a layer of heat insulated material positioned between said outside wall and said middle wall, and a layer of sound absorption material positioned between said perforated inside wall and said middle wall, and said separate expansion area connected to said absorption section and aligned opposite to said reflection section, said separate expansion area having an open cavity with a layer of absorption material contained within a perforated plate, said perforated plate axially aligned with said inlet opening of said absorption section;

(b) two symmetrical members aligned parallel to each other within said absorption section, each of said members comprised of an inner wall and an outer wall with a layer of sound absorption material positioned therebetween;

(c) web attachment means for joining said two symmetrical members together at their midpoints thereby forming a hollow tubular inlet connector and a hollow tubular outlet connector, said hollow tubular inlet connector having an axis aligned parallel to both the axis of said hollow tubular outlet connector and to the axis of said tubular housing, said hollow tubular inlet connector communicating with said inlet opening in said reflection section and having a longitudinally extending slot provided therein arranged within said absorption section, said hollow tubular outlet connector communicating with said outlet opening in said reflection section and having a longitudinally extending slot provided therein arranged within said absorption section and aligned opposite to said longitudinally extending slot in said inlet connector; and (d) two separate flow passages located within said absorption section connecting said longitudinally extending slot in said hollow tubular inlet connector to said longitudinally extending slot in said hollow tubular outlet connector for the passage of said exhaust gases therebetween, said flow passages being formed by said perforated inside wall of said absorption section and by said outer walls of said two symmetrical members.

* * * * *